United States Patent [19]

Sunada

[11] Patent Number: 5,063,284

[45] Date of Patent: Nov. 5, 1991

[54] HEATING COOKER WITH TEMPERATURE CONTROL SYSTEM

[75] Inventor: Satoru Sunada, Yokohama, Japan

[73] Assignee: Kabushiki Kaisha Toshiba, Kawasaki, Japan

[21] Appl. No.: 512,280

[22] Filed: Apr. 20, 1990

[30] Foreign Application Priority Data

Apr. 25, 1989 [JP] Japan ..... 1-103494

[51] Int. Cl.[5] ..... H05B 1/02

[52] U.S. Cl. ..... 219/497; 219/492; 219/501

[58] Field of Search ..... 219/494, 492, 497, 499, 219/501, 505, 509; 307/117

[56] References Cited

U.S. PATENT DOCUMENTS

| | | | |
|---|---|---|---|
| 3,649,905 | 3/1972 | Krupa | 219/497 |
| 3,789,190 | 1/1974 | Orosy et al. | 219/497 |
| 3,961,236 | 6/1976 | Rodek et al. | 219/497 |

*Primary Examiner*—Mark H. Paschall

*Attorney, Agent, or Firm*—Foley & Lardner

[57] ABSTRACT

A heating cooker comprises a heating lamp for emitting infrared rays to heat an object to be heated; a temperature detector for detecting an ambient temperature around the heating lamp, and providing a signal if the ambient temperature is higher than a preset value; an output controller for controlling a heat output of the heating lamp upon receiving the signal from the temperature detector; and an invalidating device for invalidating signals from the temperature detector for a predetermined time period after the output controller controls the heat output of the heating lamp.

5 Claims, 5 Drawing Sheets

HEATING COOKER WITH TEMPERATURE CONTROL SYSTEM

BACKGROUND OF THE INVENTION

1. Field of the Invention

The present invention relates to a heating cooker employing heating lamps such as halogen lamps as a heat source that emits infrared rays to heat an object.

2. Description of the Prior Art

Various heating cookers employing heating lamps such as halogen lamps that emit infrared rays have been proposed in recent years. A heating cooker of this type has a heat resistant top plate over the halogen lamps. An object to be heated is placed on the top plate. The top plate is made of, for example, tempered glass that transmits the infrared rays. A reflector is arranged under the halogen lamps to reflect the infrared rays toward the object on the top plate. The heating cooker heats the object not only directly with the infrared rays but also with heat of the halogen lamps conducted through the top plate.

The top plate of the heating cooker has, however, a relatively large heat capacity and low thermal conductivity, so that a temperature of the object on the top plate may not be increased rapidly at the start of heating.

To cope with this, the heating cooker usually employs a large output heat source such as halogen lamps having an output capacity of 2 kw (kilowatts), and other techniques for improving thermal efficiency.

For example, a heat source of the heating cooker may comprise a plurality of halogen lamps, and upper and lower heat insulators each having an annular shape, for holding the halogen lamps between them. The top face of the upper heat insulator is in contact with the bottom face of the top plate. The lower heat insulator is arranged in a receiver. The top plate, upper and lower heat insulators, and receiver define a sealed interior space of the heat source.

This arrangement may cause, however, another problem that, when the halogen lamps are continuously operated, an ambient temperature around the halogen lamps inside the heat source sometimes exceeds the heat resistive temperature (about 850° C.) of a quartz glass tube forming a bulb of each halogen lamp.

To deal with this, a thermostat is disposed to detect the temperature inside the heat source. When the temperature exceeds a preset value, the thermostat operates to stop supplying electric power to the halogen lamps, or to lower the heat output of the halogen lamps. The temperature inside the heat source, however, changes slowly and does not quickly follow the operation of the thermostat. This causes the thermostat to operate repeatedly. Such repetitive operation of the thermostat may unnecessarily lower the heat output of the halogen lamps and the temperature inside the heat source, thereby the service lives of the halogen lamps.

SUMMARY OF THE INVENTION

An object of the present invention is to provide a heating cooker that can properly control a temperature inside a heat source and extend the service life of a halogen lamp of the heat source.

Another object in present invention is to provide a heating cooker that can properly control the heat output of a heat source and prevent an unwanted decrease of the heat output.

In order to accomplish the objects, the present invention provides a heating cooker comprising heating lamps for emitting infrared rays to heat an object, temperature detecting means for detecting an ambient temperature around the heating lamps and providing a signal if the ambient temperature is higher than a preset value, output controlling means for controlling a heat output of the heating lamps upon receiving the signal from the temperature detecting means, and invalidating means for invalidating signals from the temperature detecting means for a predetermined time period after the output controlling means controls the heat output.

According to the heating cooker of the present invention, the heating lamps emit infrared rays to heat the object to be heated. The temperature detecting means detects an temperature around the heating lamps and provides the signal if the ambient temperature is larger than the preset value. The output controlling means controls a heat output of the heating lamps upon receiving the signal from the temperature detecting means. For a predetermined time period after the heat output of the heating lamps is controlled, an invalidating means invalidates signals provided by the temperature detecting means. This arrangement prevents the heat output of the heating lamps from being frequently controlled, thereby extending service lives of the heating lamps.

These and other objects, features and advantages of the present invention will be more apparent from the following detailed description of preferred embodiments in conjunction with the accompanying drawings.

DETAILED DESCRIPTION OF THE EMBODIMENTS

Figure 2:
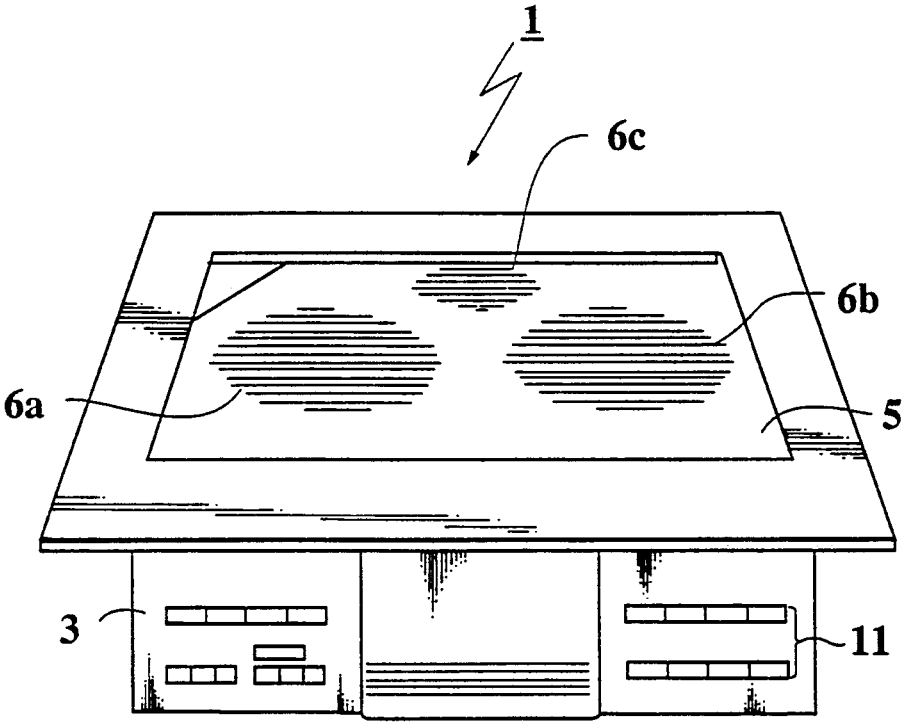
FIG. 2 is a perspective view showing the heating cooker.

FIG. 2 is a perspective view showing a heating cooker 1 according to an embodiment of the present invention. The heating cooker 1 comprises a casing 3 having an open top, and a top plate 5 disposed on the casing 3. The top plate 5 has heating positions 6*a*, 6*b*, and 6*c* under which heaters 7 (FIGS. 3*a* and 3*b*) are arranged respectively. Each of the heaters 7 has four halogen lamps 9. The halogen lamps 9 emit proper infrared rays such as near infrared rays, intermediate infrared rays, and far infrared rays that penetrate particular materials. The heating cooker 1 has a control portion 11 with cooking switches and indicator lamps such as LEDs for indicating heating conditions.

The top plate 5 is made of, for example, heat resistant glass that easily transmits the infrared rays emitted from the halogen lamps 9. Objects to be heated are placed on the top plate 5 at the heating positions 6*a*, 6*b*, and 6*c*, respectively.

Figure 3A:
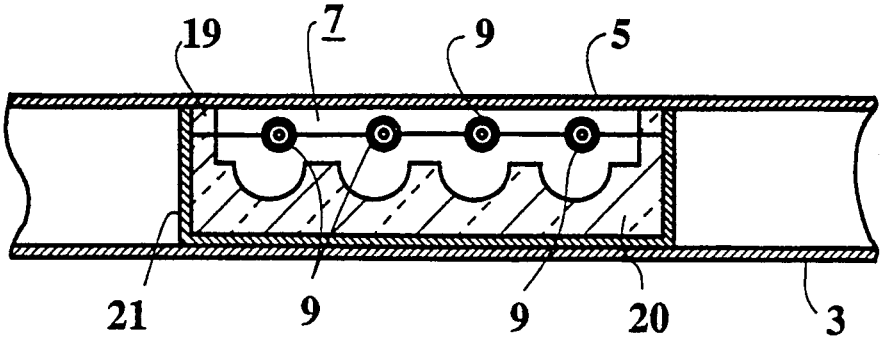
FIG. 3*a* is a sectional view showing a heater of the heating cooker.
Figure 3B:
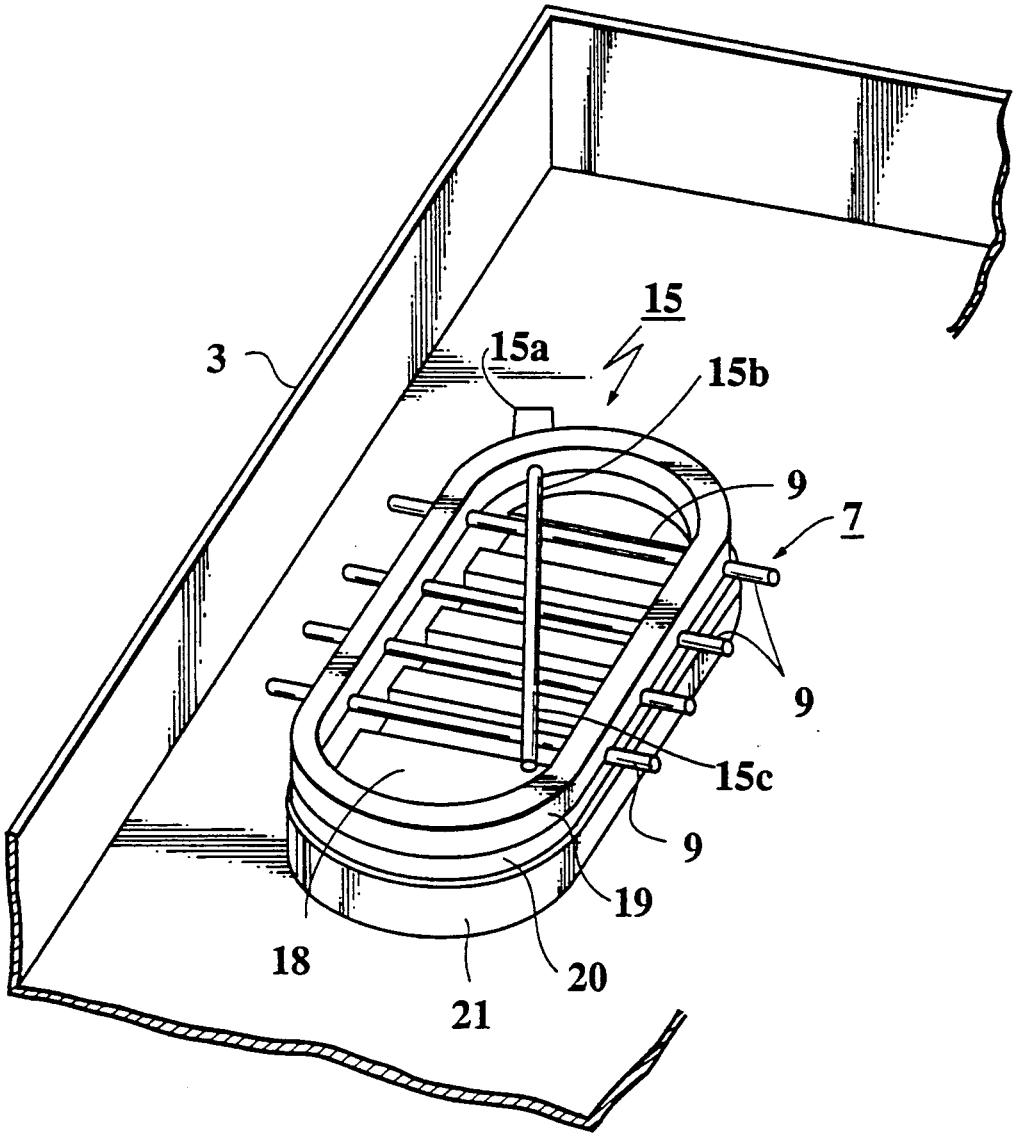
FIG. 3*b* is a perspective view showing the heater.

FIG. 3*a* is a vertical section showing one of the heaters 7, and FIG. 3*b* a perspective view showing the one heater 7. The heater 7 comprises the four halogen lamps 9, an annular upper heat insulator 19, and an annular lower heat insulator 20. The halogen lamps 9 are held between the upper and lower heat insulators 19 and 20. The top face of the upper heat insulator 19 is in contact with the bottom face of the top plate S. A reflector 18 is disposed over the lower heat insulator 20 to reflect the infrared rays emitted from the halogen lamps 9 toward an object placed on the top plate 5. The lower heat insulator 20 is positioned in a receiver 21, which is fixed to the bottom of the casing 3.

The top plate 5, the upper heat insulator 19 whose top face is in contact with the bottom face of the top plate 5, and the lower heat insulator 20 received in the receiver 21 define a sealed interior space of the heater 7. A thermostat 15 is disposed in the sealed interior space to act in response to an ambient temperature around the halogen lamps 9 inside the heater 7.

The thermostat 15 comprises an outer metal tube 15*b*, a heat sensing metal bar 15*c* disposed inside the outer tube 15*b* to expand or contract in response to a temperature change, and a switch 15*a* to be opened and closed in response to the expansion and contraction of the heat sensing metal bar 15*c*. The outer tube 15*b* and heat sensing metal bar 15*c* are arranged inside the heater 7, and the switch 15*a* is fitted to the upper heat insulator 19. The switch 15*a* is opened when the temperature inside the heater 7 exceeds a present value Ts which is, for example, 750° C.

Figure 4:
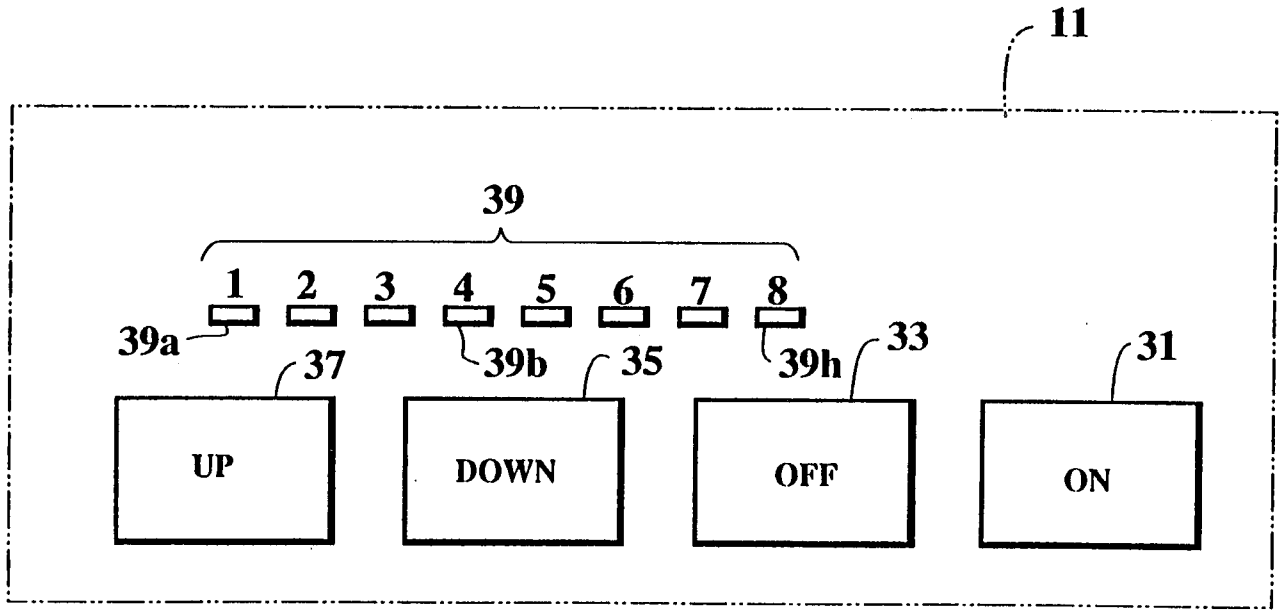
FIG. 4 is a view showing a control portion of the heating cooker.

FIG. 4 shows the control portion 11 of the heating cooker 1. The control portion 11 has an ON switch 31 for energizing the halogen lamps 9, an OFF switch 33 for deenergizing the halogen lamps 9, a DOWN switch 35 for reducing a current supplied to the halogen lamps 9, and an UP switch 37 for increasing a current supplied to the halogen lamps 9. An indicating portion 39 comprises eight LEDs provided with level indications from 1 to 8 for indicating a heat output level of the halogen lamps 9. Namely, the indicating portion 39 indicates the amount of a current supplied to the halogen lamps 9 in eight stages from level 1 to level 8. The control portion 11 is provided for each of the heaters 7.

Figure 1:
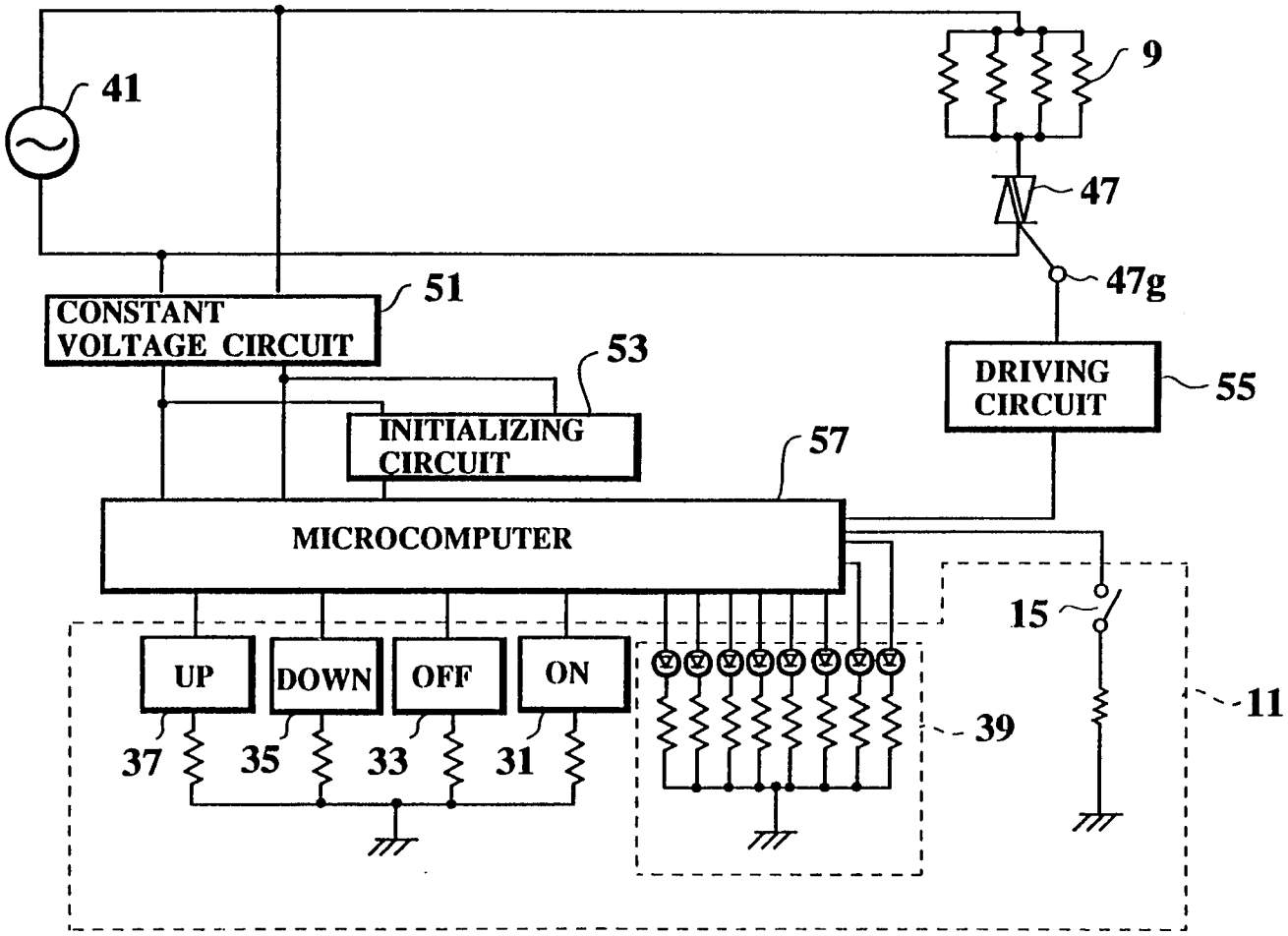
FIG. 1 is a circuit diagram showing a heating cooker according to an embodiment of the present invention.

FIG. 1 is a circuit diagram showing a control circuit for controlling the heater 7 in response to signals from the thermostat 15 and control portion 11. An area incorporating the control circuit is isolated by heat insulators from areas incorporating the heaters 7.

The four halogen lamps 9 of each of the heaters 7 are connected in parallel with each other, with an AC power source 41, and with a triac 47. The AC power source 41 is connected with an initializing circuit 53 through a constant voltage circuit 51, which converts a voltage of the AC power source 41 into a constant DC voltage. The initializing circuit 53 generates an initializing signal to initialize a microcomputer 57. A driving circuit 55 receives a driving signal from the microcomputer 57, and provides a gate signal to a gate terminal 47*g* of the triac 47.

The microcomputer 57 is supplied with an output of the constant voltage circuit 51, and initialized by the initializing signal from the initializing circuit 53. The microcomputer 57 has output controlling means that controls the driving circuit 55 in response to signals from the thermostat 15, thereby controlling the amount of a current supplied to the halogen lamps 9. The output controlling means achieves a so-called phase control to control a duty ratio of the triac 47, thus controlling a heat output of the halogen lamps 9. When a signal is provided by the thermostat 15 to the output controlling means, the heat output of the halogen lamps 9 is reduced step by step, each time by, for example, 0.1 kw, i.e., 5% of the maximum output of 2 kw of the heater 7.

The microcomputer 57 has invalidating means for invalidating signals from the thermostat 15 for a predetermined time period TO which is, for example, 15 seconds, after the output controlling means controls the heat output of the halogen lamps 9.

The microcomputer 57 is connected to the ON switch 31, OFF switch 33, DOWN switch 35, and Up switch 37 to execute various control processes in accordance with operations of these switches. The microcomputer 57 is also connected to the indicating portion 39 to control indications of the indicating portion 39 according to the operations of the switches.

Operation of the embodiment of the present invention will be explained with reference to FIGS. 5*a* to 5*c*.

Figure 5A:
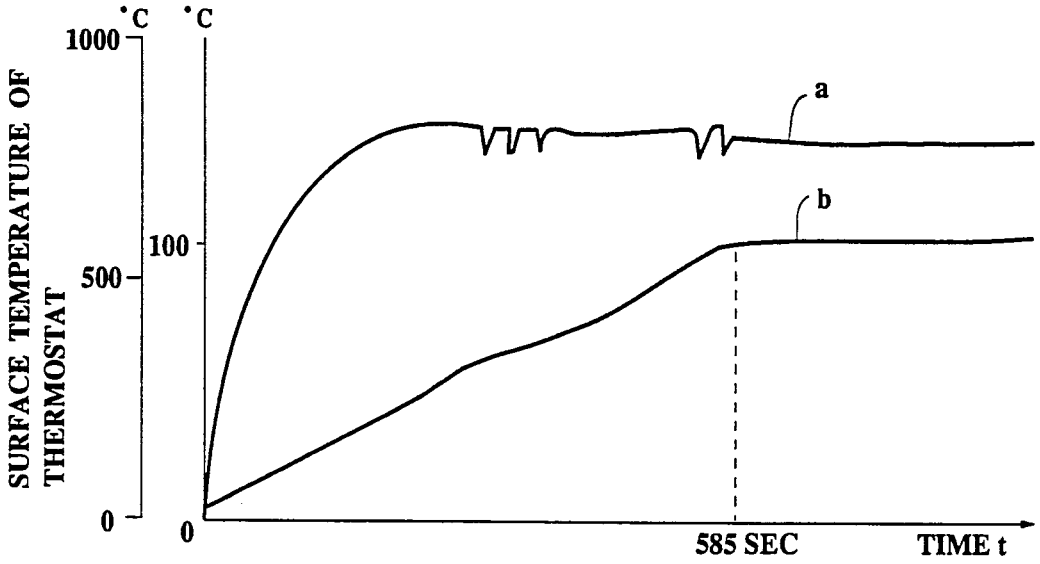
FIGS. 5*a*, 5*b*, and 5*c* are views showing operating characteristics of the heating cooker.

A curve "a" of FIG. 5*a* represents changes in the surface temperature of the heat sensing metal bar 15*c* of the thermostat 15, and a curve "b" changes in the temperature of two liters of water contained in a pot that is heated by one of the heaters 7 of the heating cooker 1 of the present invention.

The ON switch 31, UP switch 37, and DOWN switch 35 may be operated to set the heat output of the halogen lamps 9 of the one heater 7 to, for example, the maximum value (2 kw). The halogen lamps 9 heat the pan placed on the top plate 5 by heat radiation and indirectly by heat conduction through the top plate 5. At this time, a temperature inside the heater 7 rapidly increases. When the temperature inside the heater 7 exceeds the preset value Ts at time T1 in FIG. 5*b*, the thermostat 15 performs an OFF operation, i.e., a detecting operation and provides a signal.

Upon receiving the signal from the thermostat 15, the microcomputer 57 stops supplying electric power to the halogen lamps 9. If the temperature inside the heater 7 decreases to a safety value due to the power supply stoppage. the thermostat 15 performs an ON operation at time T2. Then, the microcomputer 57 resumes supplying electric power to the halogen lamps 9. At this time, the microcomputer 57 phase-controls the triac 47 to reduce the maximum heat output of the halogen lamps 9 by 0.1 kw to 1.9 kw from the preceding 2 kw.

Figure 5B:
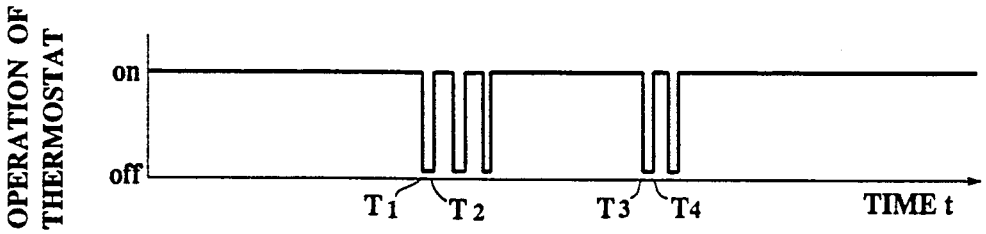
Figure 5C:
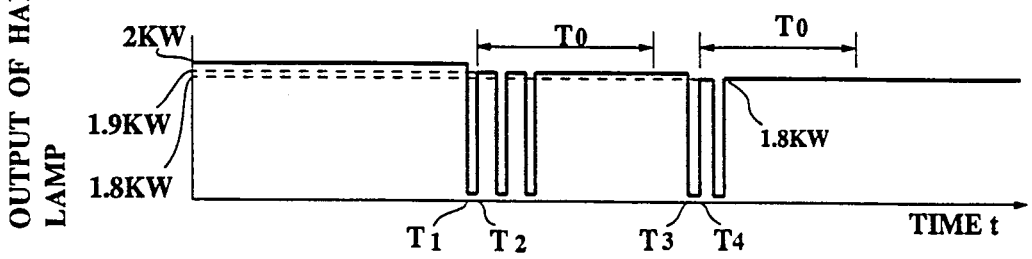

After the heat output of the halogen lamps 9 is reduced at time T2 of FIG. 5*c*, the invalidating means is activated to invalidate signals from the thermostat 15 for the predetermined time period TO from the time T2.

Meanwhile, the thermostat 15 may repeat the OFF operation several times as shown in FIG. 5*b* because the temperature inside the sealed heater 7 does not decrease rapidly after the maximum heat output of the halogen lamps 9 is decreased to 1.9 kw. However, signals from the thermostat 15 are invalidated for the predetermined time period TO not to decrease the maximum heat output of the halogen lamps 9 from 1.9 kw. Namely, the maximum heat output of the halogen lamps 9 is maintained at 1.9 kw for the time period TO, while supply of electricity to the halogen lamps 9 is being turned on and off in response to operations of the switch 15*a* of the thermostat 15.

If the thermostat 15 performs an OFF operation at time T3 after the end of the predetermined time period TO, the heat output of the halogen lamps 9 is again reduced when the thermostat 15 performs an ON operation at time T4 in FIG. 5*c*. At this time, the maximum heat output of the halogen lamps 9 is further decreased by 0.1 kw to 1.8 kw from the preceding 1.9 kw. In the similar manner, signals from the thermostat 15 are invalidated for the predetermined time period TO from the time T3 to maintain the new maximum heat output 1.8 kw of the halogen lamps 9 for the time period TO. During this period, supply of electricity to the halogen lamps 9 is turned on and off in response to operations of the switch 15*a* of the thermostat 15.

In this way, the maximum heat output of the halogen lamps 9 is kept at a constant value for the predetermined time period TO, and only a current supply to the halogen lamps 9 is turned on and off in response to operations of the switch 15*a* of the thermostat 15, thereby accurately controlling the temperature inside the heater 7.

In the above embodiment, current to the halogen lamps 9 is cut for the OFF period of the thermostat 15 between, for example, T1 and T2. Alternatively, the heat output of the halogen lamps 9 may be set to about a half of the preceding value for the OFF period to more precisely control the temperature inside the heater 7.

In summary, according to a heating cooker of the present invention, signals from temperature detecting means are invalidated for a predetermined time period after output controlling means controls the heat output of heating lamps of a heater, so that a temperature of the heater can correctly be controlled to elongate service lives of the heating lamps.

Various modifications will become possible for those skilled in the art after receiving the teachings of the present disclosure without departing from the scope thereof.

What is claimed is:

1. A heating cooker, comprising:

a heating lamp for emitting infrared rays to heat an object to be heated;

temperature detecting means for detecting an ambient temperature around said heating lamp, and providing a signal if the ambient temperature is higher than a preset value;

output controlling means for controlling a heat output of said heating lamp by decreasing the amount of energy supplied to the heating lamp per unit of time, upon receiving the signal from said temperature detecting means; and invalidating means for invalidating signals from said temperature detecting means for a predetermined time period after said output controlling means controls the heat output of said heating lamp.

2. The heating cooker as claimed in claim 1, wherein said output controlling means reduces a heat output of said heating lamp by a predetermined ratio upon receiving the signal from said temperature detecting means, and maintains the heat output of said heating lamp for the predetermined time period during which said invalidating means invalidates signals from said temperature detecting means.

3. The heating cooker as claimed in claim 2, wherein said output controlling means controls the supply of electricity to said heating lamp according to signals provided by said temperature detecting means.

4. A heating cooker, comprising:

a heating lamp for emitting infrared rays to heat an object to be heated;

temperature detecting means for detecting an ambient temperature around said heating lamp, and providing a signal if the ambient temperature is higher than a preset value;

output controlling means for controlling a heat output of said heating lamp by decreasing the amount of energy supplied to the heating lamp per unit of time, upon receiving the signal form said temperature detecting means; and invalidating means for invalidating signals from said temperature detecting means for a predetermined time period after said output controlling means controls the heat output of said heating lamp, said output controlling means being constructed to reduce a maximum heat output of said heating lamp by a predetermined ratio upon receiving the signal from said temperature detecting means, and maintains the maximum heat output of said heating lamp for the predetermined time period during which said invalidating means invalidates signals from said temperature detecting means.

5. A heater cooker, comprising:

a heating element;

a power source connected with said heating element for supplying an electronic energy to said heating element to produce heat;

a temperature sensing means located near said heating element for producing a signal indicating that the temperature measured by said temperature sensing means exceeds a predetermined temperature; and a control means connected to said power source and said sensing means for decreasing the amount of energy per unit time supplied to said heating element when said signal is produced;

wherein, said control means maintains, for a predetermined time period just after decreasing said amount of energy, the decreased amount of energy supplied to said heating element even when said sensing means produces again said signal indicating that the temperature at said temperature sensing means exceeds a predetermined temperature.

* * * * *